US005201682A

United States Patent [19]

Nakagawa et al.

[11] Patent Number: 5,201,682

[45] Date of Patent: Apr. 13, 1993

[54] CRT EXHAUST OVEN

[75] Inventors: Hiroshige Nakagawa, Sakurai; Shigeo Yamamto, Tondabayashi, both of Japan

[73] Assignee: Chugai Ro Co., Ltd., Osaka, Japan

[21] Appl. No.: 791,247

[22] Filed: Nov. 13, 1991

[30] Foreign Application Priority Data

Nov. 21, 1990 [JP] Japan ..... 2-319915

[51] Int. Cl.[5] ..... H01J 9/385

[52] U.S. Cl. ..... 445/73; 445/70; 432/212

[58] Field of Search ..... 445/70, 73, 66; 432/212; 65/119

[56] References Cited

U.S. PATENT DOCUMENTS 4,752,268 6/1988 Kataoka et al. ..... 445/66

FOREIGN PATENT DOCUMENTS 54-12258 1/1979 Japan ..... 445/70
54-68151 6/1979 Japan ..... 445/73
57-13650 1/1982 Japan ..... 445/73

*Primary Examiner*—Richard K. Seidel
*Assistant Examiner*—Jeffrey T. Knapp
*Attorney, Agent, or Firm*—Wenderoth, Lind & Ponack

[57] ABSTRACT

A CRT exhaust oven for heat-treating CRTs includes an oven housing, a baffle structure accommodated in the oven housing for circulation of atmosphere within the oven housing, and a plurality of exhaust carts capable of travelling below the oven housing. Each of the exhaust carts is provided with two exhaust heads having different heights aligned in the direction of travel of the exhaust carts so that there is no clearance, as viewed from above, between two adjoining CRTs mounted on respective exhaust heads of each exhaust cart. Each of the exhaust carts travels intermittently below the oven housing. The baffle structure has a large number of upper and lower holes formed on respective sides thereof in the direction of travel of the exhaust carts. The atmosphere introduced inside the baffle structure through the lower holes is directed to funnel portions of the two adjoining CRTs having different heights whereas the atmosphere introduced inside the baffle structure through the upper holes is directed to panel portions of the two adjoining CRTs.

5 Claims, 2 Drawing Sheets

CRT EXHAUST OVEN

BACKGROUND OF THE INVENTION

1. Field of the Invention

The present invention relates to a CRT exhaust oven capable of heating and cooling down CRTs while exhausting gases contained therein.

2. Description of the Prior Art

Conventionally, a CRT exhaust oven generally comprises an oven body and a plurality of exhaust carts, as disclosed in Japanese Utility Model Application (examined) No. 61-27935, Japanese Patent Application (examined) No. 2-22317, Japanese Patent Application (examined) No. 2-22318, or the like. Each cart holds either one CRT or two CRTs aligned in the direction of travel of the exhaust carts and is fed into the exhaust oven. While the CRTs are conveyed through the oven, they are heat-treated by hot or cool atmospheric circulation in the exhaust oven. At the same time, gases within the CRTs are evacuated by a vacuum pump provided on the exhaust cart.

In general, as shown in FIGS. 1 and 2, a clearance $\alpha 1$ of approximately 100 mm is provided between two adjoining CRTs 20 mounted on an exhaust cart 15, as viewed from above.

Such a predetermined clearance necessitates a longer exhaust oven if a number of exhaust carts are employed for heat-treating and evacuating a predetermined number of CRTs.

This not only increases the cost of equipment but also lowers thermal efficiency.

SUMMARY OF THE INVENTION

The present invention has been developed to overcome the above-described disadvantage.

It is accordingly an object of the present invention to provide an improved CRT exhaust oven of which the overall length can be shortened by providing an arrangement for mounting two CRTs onto each exhaust cart and thus limiting the length of the exhaust cart.

Another object of the present invention is to provide a CRT exhaust oven of the above-described type which is capable of uniformly heat-treating the two CRTs on the exhaust cart.

In accomplishing these and other objects, according to one preferred embodiment of the present invention, there is provided a CRT exhaust oven comprising an oven housing, a baffle structure accommodated in the oven housing for circulation of atmosphere within the oven housing, and a plurality of exhaust carts capable of intermittently travelling below the oven housing. Each of the exhaust carts is provided with two adjoining exhaust heads having different heights aligned in a direction of travel of the exhaust carts so that there is no clearance, as viewed from above, between two adjoining CRTs mounted on respective exhaust heads of each exhaust cart.

The baffle structure has a large number of upper and lower holes formed on respective sides thereof in the direction of travel of the exhaust carts. The atmosphere introduced inside the baffle structure through the upper and lower holes is directed to panel portions and funnel portions of the two adjoining CRTs, respectively.

Advantageously, the upper holes are composed of two generally vertically spaced rows of a large number of generally horizontally aligned holes on each side of the baffle structure and the two rows of the holes are alternately formed in the direction of travel of the exhaust carts so that the atmosphere is directed obliquely downward to the panel portions of the respective adjoining CRTs.

BRIEF DESCRIPTION OF THE DRAWINGS

The above and other objects and features of the present invention will become more apparent from the following description taken in conjunction with a preferred embodiment thereof with reference to the accompanying drawings, throughout which like parts are designated by like reference numerals, and wherein.

DETAILED DESCRIPTION OF THE PREFERRED EMBODIMENTS

Figure 1:
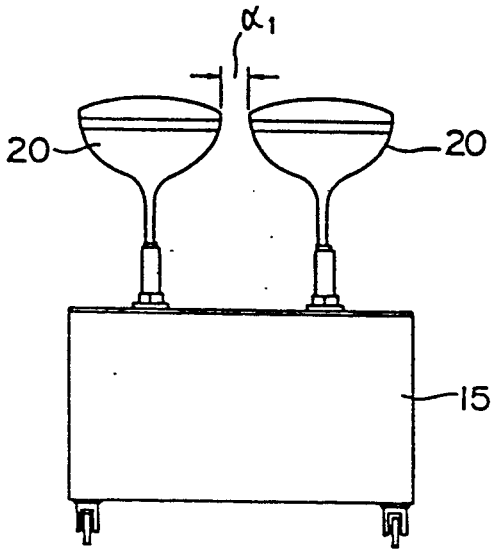
Fig. 1 PRIOR ART
FIG. 1 is an elevational view of a conventional exhaust cart on which two CRTs are mounted.
Figure 2:
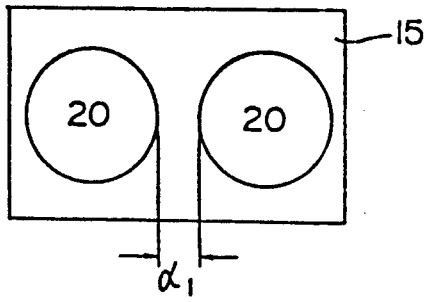
Fig. 2 PRIOR ART
FIG. 2 is a top plan view of the exhaust cart of FIG. 1.
Figure 3:
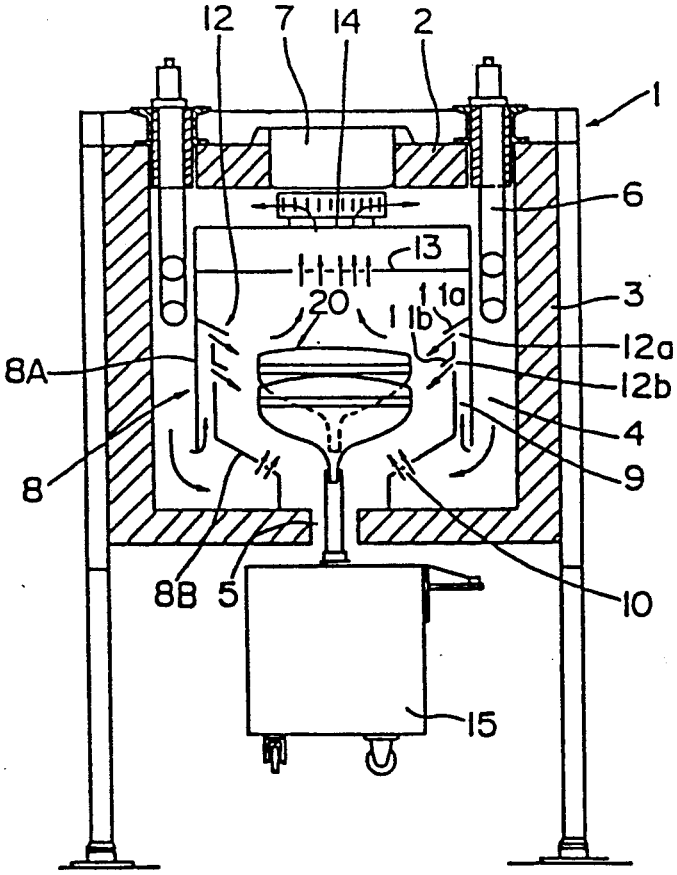
FIG. 3 is a cross-sectional view of a CRT exhaust oven according to the present invention.
Figure 4:
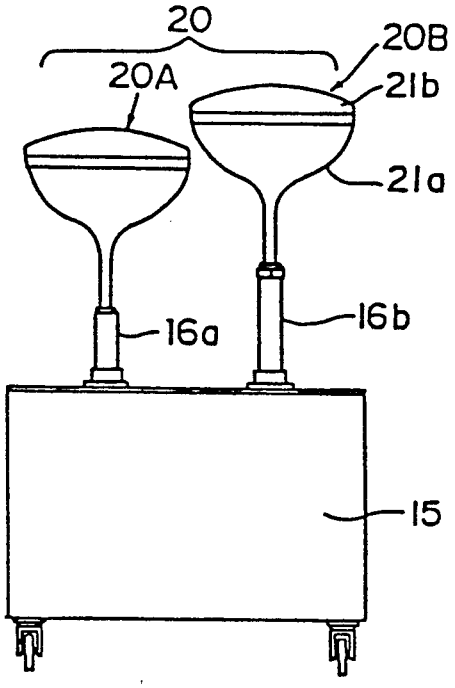
FIG. 4 is an elevational view of an exhaust cart employed in the CRT exhaust oven of FIG. 3.

Referring now to the drawings, there is shown in FIG. 3 a CRT exhaust oven according to the present invention, which comprises an oven housing 1 and a plurality of exhaust carts 15 capable of intermittently travelling below the oven housing 1. The oven housing 1 includes a heating zone, a slow cooling zone, and a cooling zone. FIG. 3 particularly illustrates the heating zone or the slow cooling zone.

As shown in FIG. 3, a baffle structure 8 is provided inside the oven housing 1. A heating arrangement 6, such as radiant tubes, is provided in an atmosphere recirculation channel 4, which is formed by the baffle structure 8 and an oven wall. Embedded in an oven ceiling 2 is a recirculation fan 7 which draws the atmosphere inside the baffle structure 8 via a plurality of holes formed in a central portion of a partition plate 13 and an atmosphere intake 14 formed above the partition plate 13.

Figure 6:
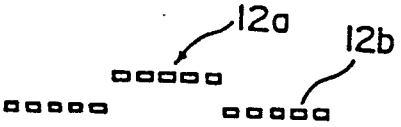
FIG. 6 is an elevational view of upper air discharge holes formed in a baffle structure provided in the CRT exhaust oven of FIG. 3.

The baffle structure 8 comprises an upper baffle structure 8A and a lower baffle structure 8B. The lower edge of side plates of the upper baffle structure 8A is positioned above a hearth and the lower baffle structure 8B is mounted on the hearth so that side plates thereof are inside those of the upper baffle structure 8A with a predetermined clearance. The lower baffle structure 8B is provided at its lower portion with atmosphere discharge holes 10 formed in a direction longitudinally of the exhaust oven. The atmosphere discharge holes 10 are composed of multiple pairs of holes formed on respective sides of the lower baffle structure 8B. The atmosphere sent from the recirculation fan 7 is obliquely upwardly introduced into a lower portion of the lower baffle structure 8B through the holes 10. The lower baffle structure 8B is further provided at its upper portion with atmosphere discharge holes 12 into which the atmosphere from a branch channel 9 between the upper and lower baffle structures 8A and 8B is fed. The atmosphere discharge holes 12 are formed on respective sides of the lower baffle structure 8B and are composed of two generally vertically spaced rows of a large number of generally horizontally aligned holes 12a and 12b on each side of the lower baffle structure 8B. The two rows of the holes 12a and 12b are alternately formed in the direction longitudinally of the exhaust oven, as best shown in FIG. 6. The atmosphere which moves through the upper row of the holes 12a is obliquely downwardly introduced into the lower baffle structure 8B by a guide plate 11a formed at an upper portion of the branch channel 9. On the other hand, the atmosphere which moves past the lower row of the holes 12b is also obliquely downwardly introduced into the lower baffle structure 8B by a guide plate 11b formed at an intermediate portion of the branch channel 9.

The circulating atmosphere is fed from the upper and lower atmosphere discharge holes 12 and 10 towards two CRTs 20A and 20B mounted on each exhaust cart 15 and aligned in the direction of travel of the exhaust cart 15. In this event, the atmosphere from the upper row of the holes 12a is directed to a panel portion 21b of the CRT 20B whereas that from the lower row of the holes 12b is directed to a panel portion 21b of the CRT 20A positioned lower than the CRT 20B.

The lower atmosphere discharge holes 10 are a large number of regularly spaced holes each having a diameter of 8 mm. The upper atmosphere discharge holes 12 are a large number of regularly spaced rectangular openings each having a size of 40 mm×100 mm. The respective shapes of the upper and lower holes 12 and 10 are, however, not limited to the types described herein.

Figure 5:
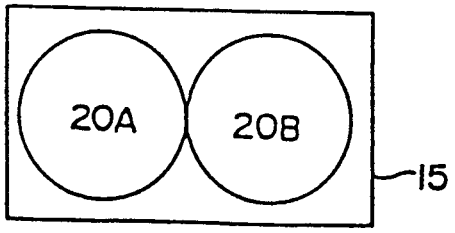
FIG. 5 is a top plan view of the exhaust cart of FIG. 4.

Each exhaust cart 15 travels intermittently below the oven housing 1 and has a pair of exhaust heads 16a and 16b having different heights aligned in the longitudinal direction of the exhaust oven. Each of the exhaust heads 16a and 16b holds a CRT 20, which is mounted so as to protrude into the baffle structure 8 through a slit 5 extending throughout the hearth in the longitudinal direction of the oven housing 1. Furthermore, as viewed from above, there is no clearance between two CRTs 20 held on respective exhaust heads 16a and 16b, as best shown in FIG. 5. That is, a peripheral edge of the panel portion 21b of the CRT 20A is positioned immediately below that of the panel portion 21b of the CRT 20B located higher than the CRT 20A, or is positioned below the panel portion 21b of the CRT 20B in overlapping relationship.

It is to be noted here that the position, angle and shape of the upper and lower atmosphere discharge holes 12 and 10, and the quantity of atmosphere to be discharged therefrom, depend upon the shape, size, and location in the exhaust oven of the CRT 20 to be heat-treated. Furthermore, in the above-described embodiment, the quantity of atmosphere to be discharged from the upper and lower holes 12 and 10 depends upon the size of the branch channel 9. For example, approximately 30% of the circulating atmosphere is introduced into the baffle structure 8 from the lower holes 10, and approximately 70% from the upper holes 12, so as to provide the panel portion 21b with greater heat transmission than a funnel portion 21a.

Accordingly, while the exhaust cart 15 travels intermittently below the oven housing 1, each CRT 20 mounted thereon is heated or cooled down by the circulating atmosphere blown into the baffle structure 8 from the upper and lower holes 12 and 10. When the exhaust cart 15 is stopped, the panel portion 21b of the CRT 20A and that of the CRT 20B are heated or cooled down by the atmosphere blown out from the holes 12b and 12a, respectively, thus compensating for the delay in the rise or drop in temperature of the panel 21b.

As is clear from the above, according to the present invention, because there is no clearance, as viewed from above, between two adjoining CRTs mounted on each exhaust cart, the exhaust cart can be made smaller and therefore the overall length of the CRT exhaust oven can be shortened. As a result, not only does the cost of equipment decrease, but the thermal efficiency also increases.

In addition, the CRT exhaust oven according to the present invention can uniformly heat-treat all the CRTs even though two adjoining CRTs mounted on each exhaust cart differ in height.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A CRT exhaust oven for heat-treating CRTs, comprising:

an oven housing having a heater for heating the atmosphere in said oven housing;

a plurality of exhaust carts capable of intermittently travelling below said oven housing in a direction of travel, each said exhaust cart having two adjacent exhaust heads extending upwardly therefrom to different heights, said adjacent exhaust heads being aligned in the direction of travel and positioned on said exhaust cart for providing, as viewed from above, no apparent clearance between two CRTs to be mounted on said adjacent exhaust heads of each said exhaust cart; and a baffle structure in said oven housing for circulating the atmosphere in said housing, said baffle structure having sides extending in the direction of travel and a plurality of upper and lower holes in said sides along the direction of travel, said lower holes being positioned in a lower portion of said sides of said baffle structure for upwardly directing atmosphere entering said baffle structure through said lower holes, said upper holes being positioned in an upper portion of said sides of said baffle structure for downwardly directing atmosphere entering said baffle structure through said upper holes, said holes comprising a plurality of holes defining a plurality of vertically-spaced horizontally-extending rows of said holes, said holes in said rows alternating between said rows such that said holes in one said row are horizontally offset with respect to said holes in another said row.

2. The CRT exhaust oven of claim 1, wherein said oven housing has a slit in the bottom thereof through which said adjacent exhaust heads extend.

3. The CRT exhaust oven of claim 1, wherein said baffle structure defines an atmosphere recirculation channel together with said oven housing circulating the atmosphere in said oven housing from the top of said baffle structure, past said heater and to said lower and upper holes.

4. The CRT exhaust oven of claim 3, wherein said baffle structure comprises an atmosphere intake at an upper portion thereof and said oven housing has a fan having the atmosphere through said intake.

5. A CRT exhaust oven for heat-treating CRTs, comprising:

an oven housing having a heater for heating the atmosphere in said oven housing;

a plurality of exhaust carts capable of intermittently traveling below said oven housing in a direction of travel, each said exhaust cart having two adjacent exhaust heads extending upwardly therefrom to different heights, said adjacent exhaust heads being aligned in the direction of travel and positioned on said exhaust cart for providing, as viewed from above, no apparent clearance between two CRTs to be mounted on said adjacent exhaust heads of each said exhaust cart; and a baffle structure in said oven housing fir circulating the atmosphere in said housing, said baffle structure having sides extending in the direction of travel and a plurality of upper and lower holes in said sides along the direction of travels, said lower holes being positioned in said sides of said baffle structure such that atmosphere entering said baffle structure through said lower holes is upwardly directed, and said upper holes being positioned in said sides of said baffle structure such that atmosphere entering said baffle structure through said upper holes in downwardly directed, said upper holes comprising a plurality of sets of holes defining a plurality of vertically-spaced horizontally-extending rows of said sets of holes, said sets of holes in said rows alternating between said rows such that said sets of holes in one said row are horizontally offset with respect to said sets of holes in another said row.

* * * * *